US011424575B2

(12) United States Patent
Wan et al.

(10) Patent No.: US 11,424,575 B2
(45) Date of Patent: Aug. 23, 2022

(54) TERMINAL RETAINER AND MATING TERMINAL RETAINER

(71) Applicant: Tyco Electronics (Shanghai) Co. Ltd., Shanghai (CN)

(72) Inventors: Feng Wan, Shanghai (CN); Haomai Yin, Shanghai (CN)

(73) Assignee: Tyco Electronics (Shanghai) Co, Ltd., Shanghai (CN)

( * ) Notice: Subject to any disclaimer, the term of this patent is extended or adjusted under 35 U.S.C. 154(b) by 9 days.

(21) Appl. No.: 16/690,368

(22) Filed: Nov. 21, 2019

(65) Prior Publication Data

US 2020/0169036 A1 May 28, 2020

(30) Foreign Application Priority Data

Nov. 23, 2018 (CN) ..... 201821961686.0

(51) Int. Cl.

| | |
|---|---|
| ***H01R 13/629*** | (2006.01) |
| ***H01R 13/516*** | (2006.01) |
| ***H01R 13/05*** | (2006.01) |
| ***H01R 13/514*** | (2006.01) |
| ***H01R 13/42*** | (2006.01) |
| ***H01R 13/52*** | (2006.01) |

(52) U.S. Cl.

CPC ..... *H01R 13/629* (2013.01); *H01R 13/05* (2013.01); *H01R 13/42* (2013.01); *H01R 13/514* (2013.01); *H01R 13/516* (2013.01); *H01R 13/5202* (2013.01)

(58) Field of Classification Search

CPC ..... H01R 13/4364; H01R 13/6272; H01R 13/629; H01R 13/05; H01R 13/42; H01R 13/4223; H01R 13/426; H01R 13/5045; H01R 13/506; H01R 13/514; H01R 13/516; H01R 13/5202; H01R 13/5208; H01R 13/6278; H01R 24/20; H01R 24/28; H01R 25/00

See application file for complete search history.

(56) References Cited

U.S. PATENT DOCUMENTS

| | | | | |
|---|---|---|---|---|
| 5,522,740 A * | 6/1996 | Plocek | ..... | H01R 13/4368 439/752 |
| 6,398,585 B1 * | 6/2002 | Fukuda | ..... | H01R 13/5208 439/587 |
| 7,351,102 B2 * | 4/2008 | Cykon | ..... | H01R 13/4368 439/587 |

(Continued)

*Primary Examiner* — Renee S Luebke
*Assistant Examiner* — Matthew T Dzierzynski

(57) ABSTRACT

The application discloses a terminal retainer and a mating terminal retainer. The terminal retainer has a plate body and a terminal isolation plate, wherein the plate body is provided with a plurality of first through-holes and/or a plurality of second through-holes; the terminal isolation plate has one end thereof disposed on the plate body and extends to a selected height from the plate body. The terminal retainer provided by the application can help a connection terminal to be stable and firm. During plugging in, the terminal retainer can prevent the connection terminal from being bent or broken under stress thereby to be safe and convenient for use. The terminal retainer is provided with a bushing, so that the connection terminals can be isolated from each other to avoid mutual interference.

19 Claims, 15 Drawing Sheets

(56) References Cited

U.S. PATENT DOCUMENTS

| | | | | |
|---|---|---|---|---|
| 7,744,390 | B2 * | 6/2010 | Tyler | H01R 13/62927 439/157 |
| 8,257,111 | B1 * | 9/2012 | Smutny | H01R 43/005 439/511 |
| 9,912,092 | B2 * | 3/2018 | Farole | H01R 13/4367 |
| 10,044,132 | B2 * | 8/2018 | Gagnon | H01R 13/443 |
| 10,367,310 | B2 * | 7/2019 | Zhu | H01R 13/50 |

* cited by examiner

TERMINAL RETAINER AND MATING TERMINAL RETAINER

TECHNICAL FIELD

The application relates to a terminal retainer and a mating terminal retainer.

BACKGROUND ART

Connectors are common components used for electrical connections. The connector is generally provided with a cavity in which a connection terminal is disposed, and the plug-in connection between two connectors enables a plug-in connection between a female terminal and a male terminal to achieve an electrical connection.

In order to enable the connection terminals to be tightly plugged in and connected, it often requires a larger force to plug the male terminal and the female terminal in place. Therefore, the connection terminal is prone to being bent or broken when plugged with a larger force during the plugging-unplugging process. Due to the suspending arrangement of the connection terminal without any protective structure, it is prone to damage in the plugging-unplugging process and inconvenient to use. In the case of many connection terminals, a larger initial force is required to plug and unplug a plurality of male terminals and female terminals simultaneously, resulting in difficulty in plugging and inconvenience in use.

SUMMARY OF INVENTION

One of the objectives of the present application is to provide a terminal retainer and a mating terminal retainer useful for protecting connection terminals to overcome at least one of the deficiencies of the prior art.

According to an aspect of the application, there is provided a terminal retainer configured for fixing connection terminals, wherein the terminal retainer comprises a plate body and a terminal isolation plate; the plate body is provided with a plurality of first through-holes and/or a plurality of second through-holes; the terminal isolation plate has one end disposed on the plate body and extends to a selected height from the plate body.

According to one embodiment of the application, the terminal isolation plate is provided between the plurality of first through-holes, between the plurality of second through-holes, and/or between the first through-hole and the second through-hole.

According to one embodiment of the application, the terminal isolation plate comprises a plurality of vertical plates and a plurality of transverse plates, the plurality of vertical plates being disposed to intersect the plurality of transverse plates; and some or all of the vertical plates extend from an upper portion to a lower portion of the plate body.

According to one embodiment of the application, some or all of the transverse plates extend from a left portion to a right portion of the plate body.

According to one embodiment of the application, the terminal isolation plate further comprises a short baffle which is disposed on the vertical plate and/or the transverse plate and protrudes from the vertical plate or the transverse plate towards one side or both sides.

According to one embodiment of the application, the short baffle protrudes from both sides of the transverse plate to an identical or different length; and the short baffle protrudes from both sides of the vertical plate to an identical or different length.

According to one embodiment of the present application, the terminal isolation plate surrounds the first through-hole and/or the second through-hole in a closed or semi-closed manner.

According to one embodiment of the application, the terminal isolation plate is a rotationally symmetric structure.

According to one embodiment of the application, the terminal isolation plate is a centrosymmetric structure or has a rotation angle of 90 degrees.

According to one embodiment of the application, the terminal retainer is a centrosymmetric structure.

According to one embodiment of the application, the plurality of first through-holes are arranged around the plurality of second through-holes; each of the first through-holes is axially aligned with one of first mounting holes; and each of the second through-holes is axially aligned with one of second mounting holes.

According to one embodiment of the application, the terminal retainer further comprises a plurality of bushings; the bushing has a tube wall and a tube cavity; one end of the bushing is disposed on the plate body, and the other end thereof protrudes from the plate body; and the tube cavity is arranged to be aligned with the first through-hole or the second through-hole in position so that the connection terminal can be inserted into the first through-hole or the second through-hole from the tube cavity.

According to one embodiment of the application, the bushings comprise a first bushing and a second bushing; the first bushing is provided with a first tube wall and a first tube cavity; each of the first tube cavities is disposed in position to be aligned with one of the first through-holes; the second bushing is provided with a second tube wall and a second tube cavity; and each of the second tube cavities is disposed in position to be aligned with one of the second through-holes.

According to one embodiment of the application, on the plate body is provided a retaining block which extends to a selected height from the plate body; and some or all of the bushings are inserted into the retaining block.

According to one embodiment of the application, the terminal retainer further comprises a hook; and the hook has one end disposed on the plate body and extends to a selected height from the plate body.

According to one embodiment of the application, the plate body is provided with a third through-hole which runs through the plate body and is disposed on one side of the hook.

According to a second aspect of the application, there is provided a mating terminal retainer comprising a plate body, wherein the plate body is provided with an accommodating groove configured for accommodating the terminal isolation plate described above.

Compared with prior art, the terminal retainer provided by the application can help the connection terminal to be stable and firm. During plugging in, the terminal retainer can prevent the connection terminal from being bent or broken under stress, so that it is safe and convenient to use. The terminal retainer is provided with a bushing, so that the connection terminals can be isolated from each other to avoid mutual interference. The arrangement of the retaining block may enhance the firmness of the terminal retainer, and enable the connection terminal to be more stable and safer to use. The arrangement of the terminal isolation plate enables the terminal retainer to be more suitable for mounting the male terminal; the bushing and the isolation plate are separately provided on two surfaces of the plate body, and therefore the male terminals on either side of the plate body can be isolated or protected. Different heights of the bushings may enable the ends of the connection terminals to be axially staggered, so that during plugging in some of the male terminals firstly contact some of the female terminals, which requires a small force to plug in. The terminal retainer is provided with a hook, so that the terminal retainer can be conveniently hooked up and connected with the mating structure in the connector cavity. The plate body is provided with a third through-hole disposed on one side of the hook, so that the hook can be disconnected from the mating structure through the third through-hole, and the terminal retainer can be conveniently disassembled.

Other features and advantages of the present application will become apparent from the following detailed description of exemplary embodiments thereof with reference to the accompanying drawings.

DETAILED DESCRIPTION OF THE INVENTION

The present application is described in detail below with reference to the accompanying drawings.

Figure 1:
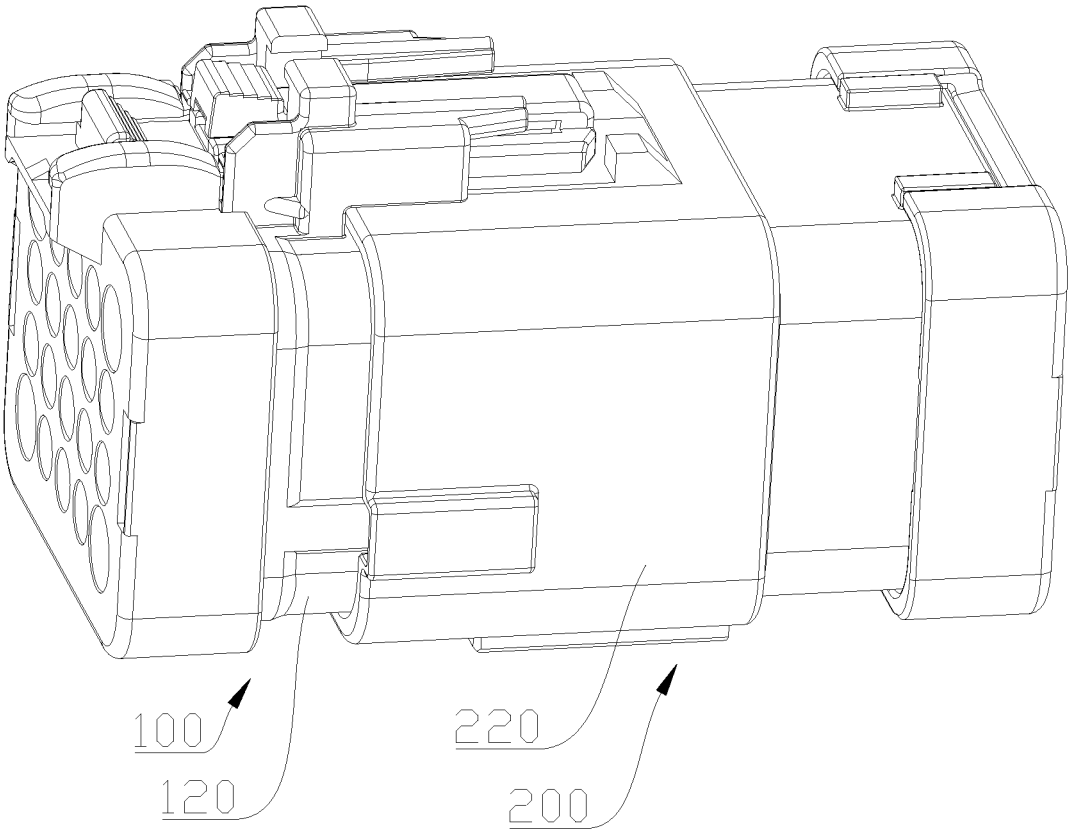
FIG. 1 is a schematic view showing a state where a connector assembly is connected to a mating connector assembly according to the present application.
Figure 2:
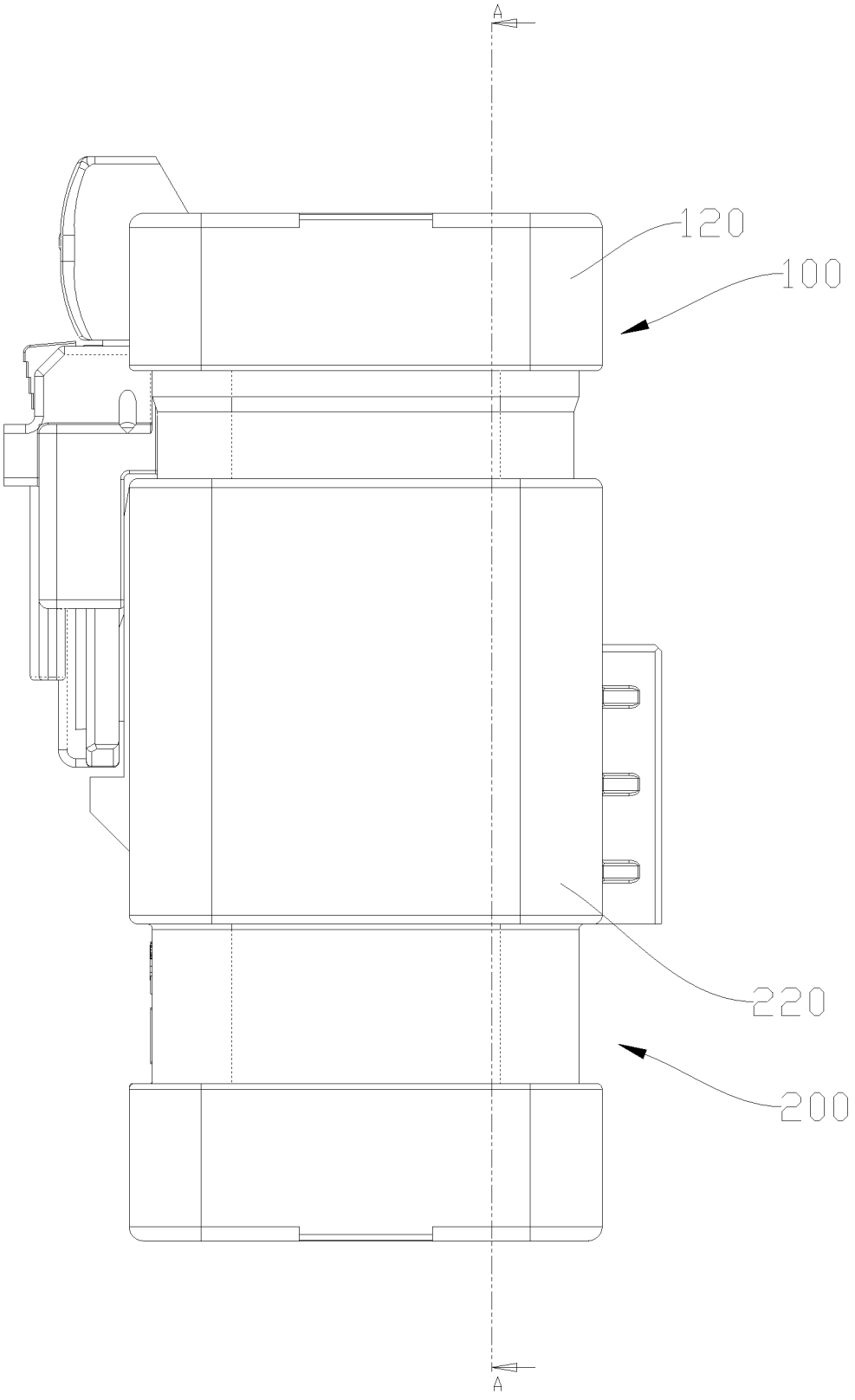
FIG. 2 is a front view of FIG. 1.
Figure 3:
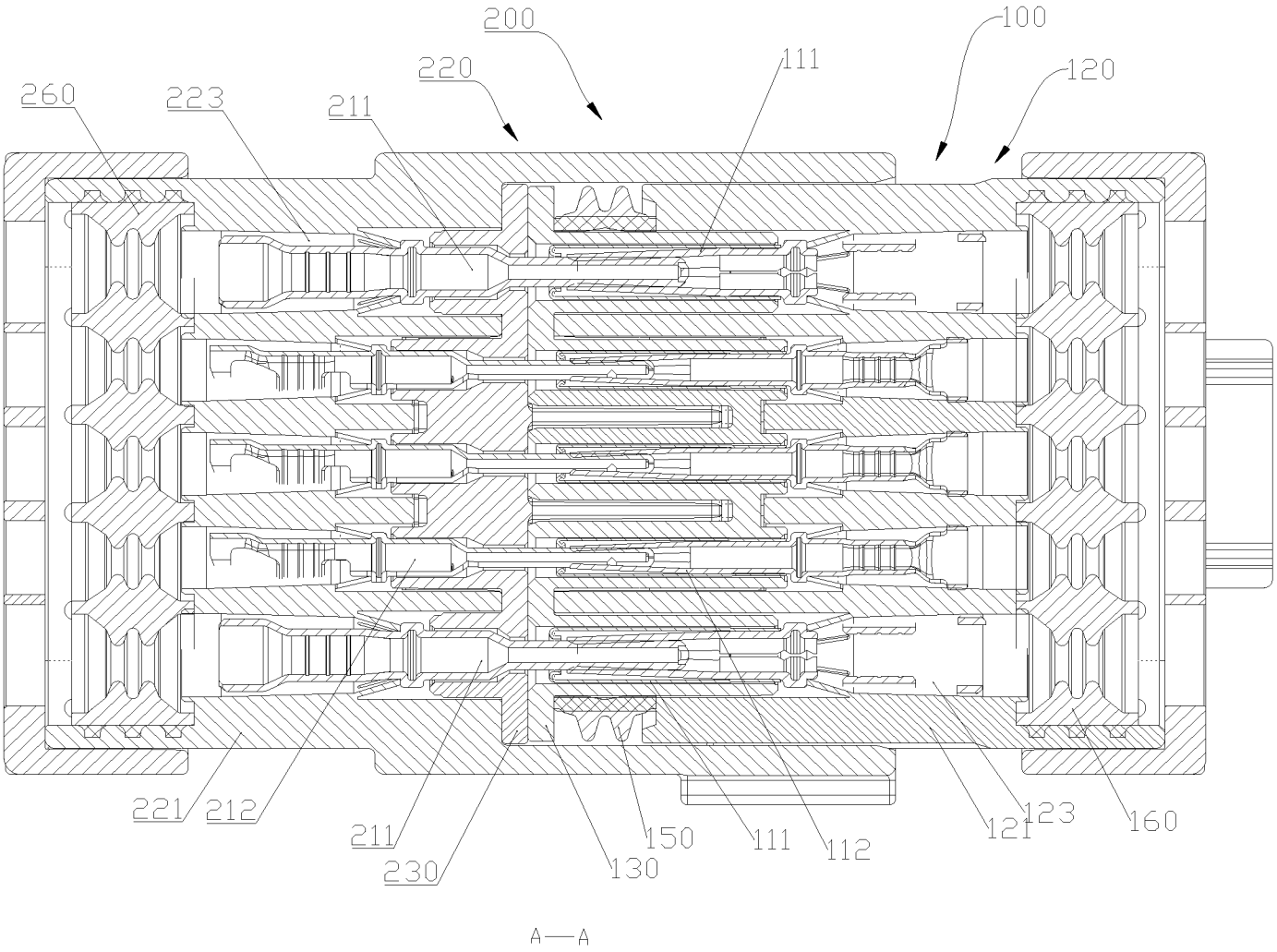
FIG. 3 is an A-A sectional view of FIG. 2.
Figure 4:
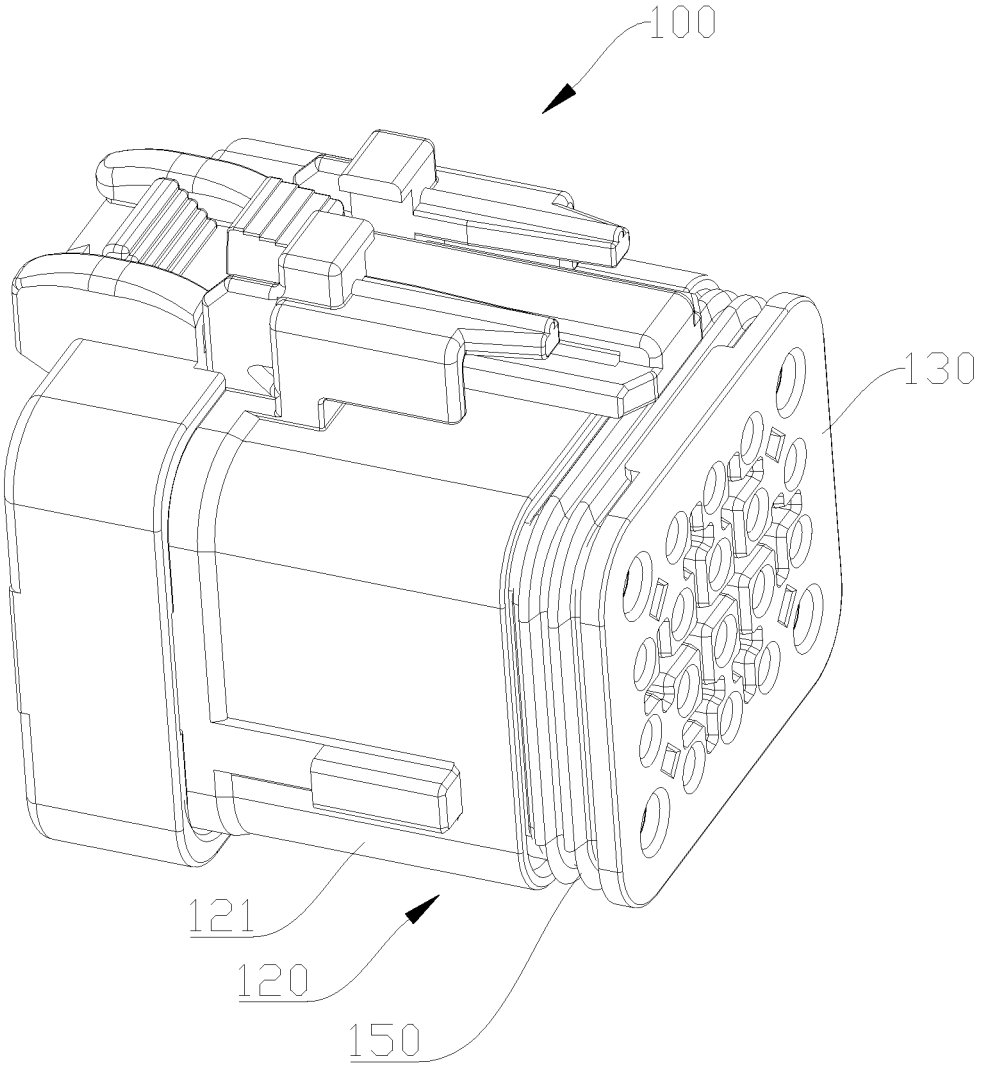
FIG. 4 is a structural schematic view of the connector assembly of the present application.
Figure 5:
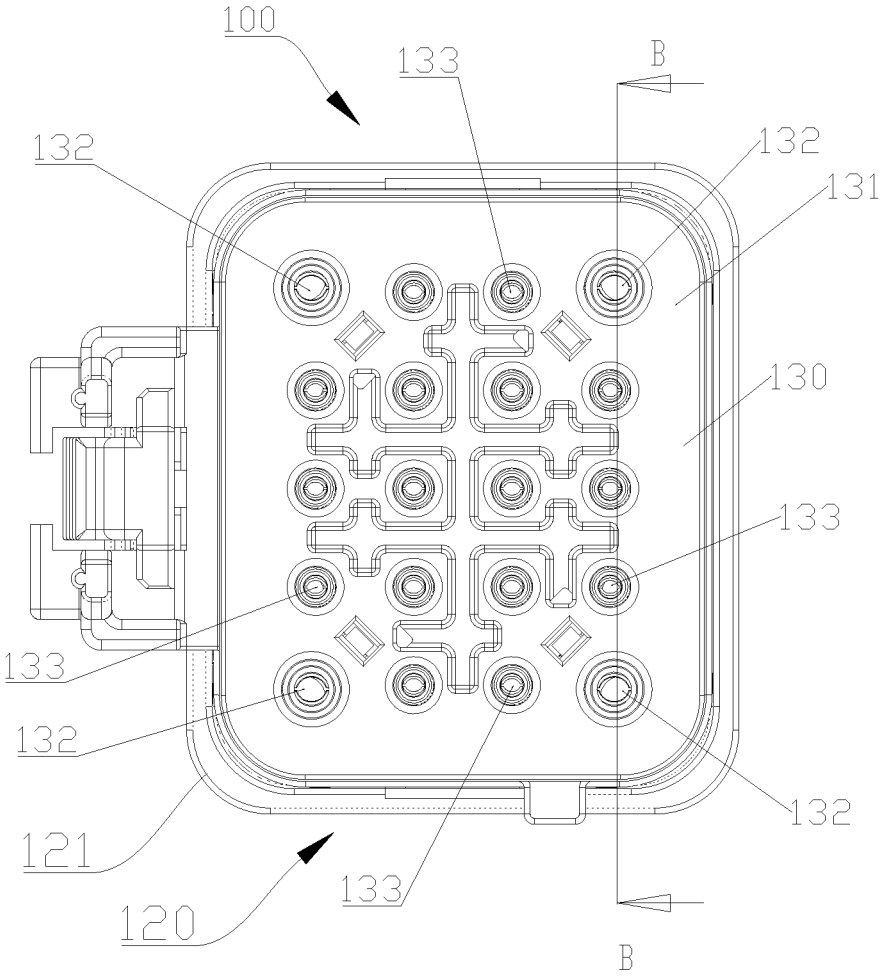
FIG. 5 is a front view of FIG. 4.

As shown in FIGS. 1 to 3, according to an aspect of an embodiment of the present application, two connector assemblies are provided, one configured for mounting a male terminal and the other configured for connecting a female terminal. The two connector assemblies are pluggably in plug-in connection. Hereinafter, in order to clearly illustrate the technical solution of the present application, one of the connector assemblies is designated as a mating connector assembly 100, and the other as a connector assembly 200. Either of the mating connector assembly 100 and the connector assembly 200 is an embodiment of the present application. Accordingly, the mating connector assembly 100 includes a mating connector 120. The connector assembly 200 includes a connector 220. Either of the mating connector 120 and the connector 220 is an embodiment of the connector described in the present application, but named differently for the purpose of clearly illustrating the present application.

Embodiment 1

The mating connector assembly 100 shown in FIGS. 1-9 is configured for mounting a female terminal 110. The connector assembly 200 is configured for mounting a male terminal 210. The two connector assemblies are further described below.

The mating connector assembly 100 includes a mating connector 120 and a mating terminal retainer 130. The mating connector 120 has a mating housing 121 and a mating cavity 122. The mating housing 121 extends lengthwise for a selected length, and a desirable length and outer shape can be determined according to a circumstance of application. The mating housing 121 encloses the mating cavity 122. The mating connector 120 is configured for mounting a connection terminal, and in this embodiment, the connection terminal are illustrated as the female terminal 110. The female terminal 110 includes a first female terminal 111 and a second female terminal 112. A structure for mounting the female terminal 110 is provided in the mating cavity 122. The structure may be a solid structure or another usable structure as long as it can fixedly mount the female terminal 110 in the mating housing 121. In the illustrated example, within the mating cavity 122 is provided a female terminal retaining portion 123 configured for fixing the female terminal 110. The female terminal retaining portion 123 is provided with a plurality of first female terminal mounting holes 124 configured for receiving the first female terminal 111 and a plurality of second female terminal mounting holes 125 configured for receiving the second female terminal 112. The first female terminal mounting hole 124 has a cross-sectional dimension larger than that of the second female terminal mounting hole 125. In the illustrated example, the first female terminal mounting hole 124 and the second female terminal mounting hole 125 are both round holes, and the first female terminal mounting hole 124 has a diameter larger than that of the second female terminal mounting hole 125. In this embodiment, the number of the first female terminal mounting holes 124 is four. The number of the second female terminal mounting holes 125 is sixteen. The four first female terminal mounting holes 124 are disposed around all of the sixteen second female terminal mounting holes 125. The four first female terminal mounting holes 124 are provided at four corners, and the sixteen second female terminal mounting holes 125 are provided within a rectangular shape defined by the four first female terminal mounting holes 124.

Within the first female terminal mounting hole 124 is provided a first stopper configured for preventing the first female terminal 111 from exiting. In the illustrated example, the first stopper includes a plurality of first female terminal clamping jaws 126 spaced circumferentially along the first female terminal mounting hole 124; each of the first female terminal clamping jaws 126 is disposed to be elastic. In an insertion direction of the first female terminal 111, a plurality of the first female terminal clamping jaws 126 are provided to form a tapered tube shape; that is, in the illustrated example, the first female terminal clamping jaws 126 reduce gradually in size from left to right.

Within the second female terminal mounting hole 125 is provided a second stopper configured for preventing the second female terminal 112 from exiting. The second stopper includes a plurality of second female terminal clamping jaws 127 spaced circumferentially along the second female terminal mounting hole 125; each of the second female terminal clamping jaws 127 is disposed to be elastic; in an insertion direction of the second female terminal 112, the plurality of the second female terminal clamping jaws 127 are arranged to form a tapered tube shape, that is, in the illustrated example, the second female terminal clamping jaws 127 reduce gradually in size from left to right.

In a length direction of the mating housing 121, the plurality of the first female terminal clamping jaws 126 in the first female terminal mounting hole 124 are arranged in a staggered manner; the plurality of the second female terminal clamping jaws 127 in the second female terminal mounting hole 125 are arranged in a staggered manner; and/or the first female terminal clamping jaw 126 in the first female terminal mounting hole 124 and the second female terminal clamping jaw 127 in the second female terminal mounting hole 125 are arranged in a staggered manner with respect to each other. In the example shown in FIG. 6, in an axial direction of the female terminal 110, the first female terminal clamping jaws 126 are more leftward than the second female terminal clamping jaws 127.

An inner surface of the mating cavity 122 of the mating housing 121 is provided with a mating protrusion 128. The mating protrusion 128 is configured to hook a hook 135 described below as a mating structure to the hook 135.

Figure 6:
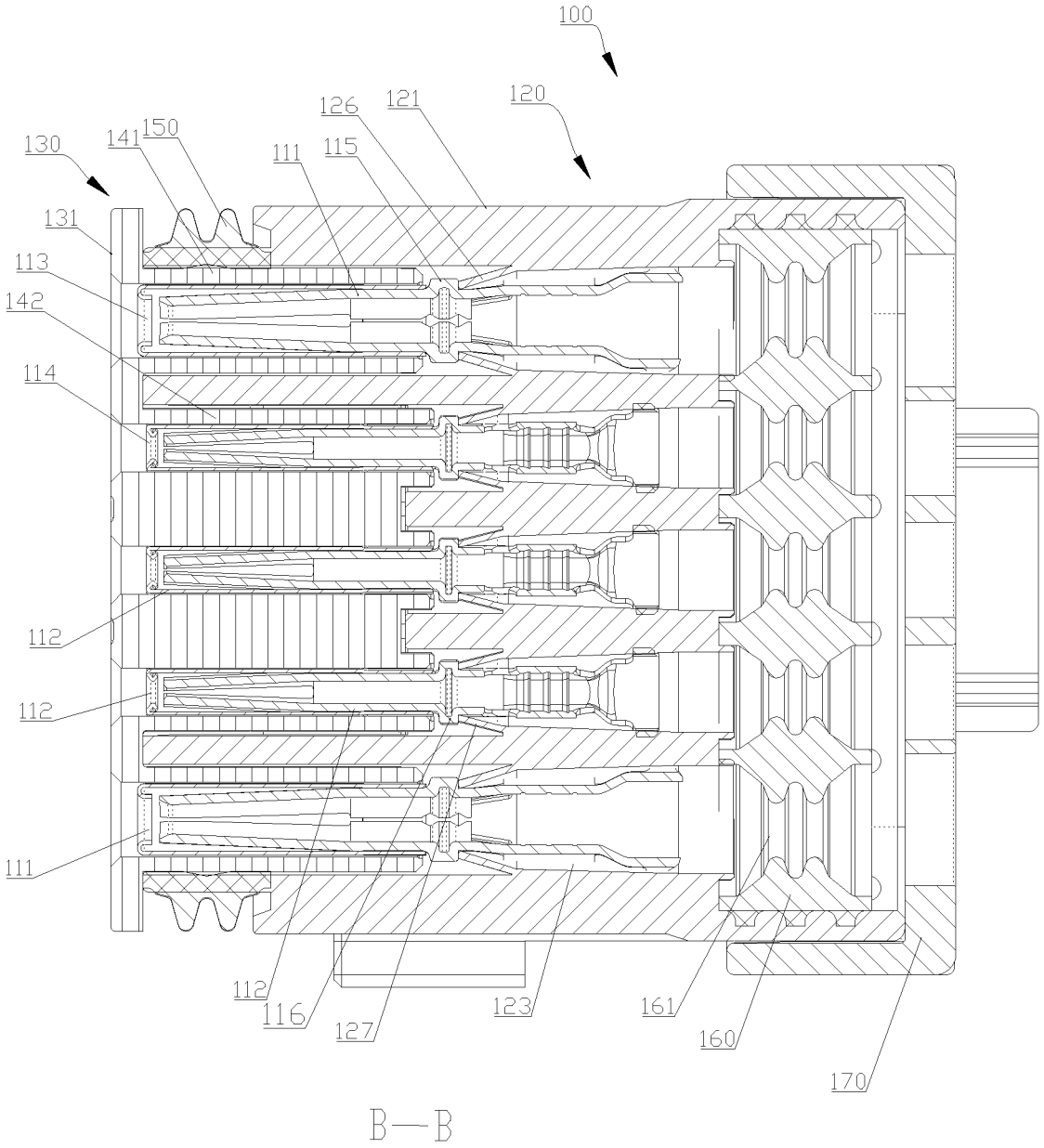
FIG. 6 is a B-B sectional view of FIG. 4.
Figure 7:
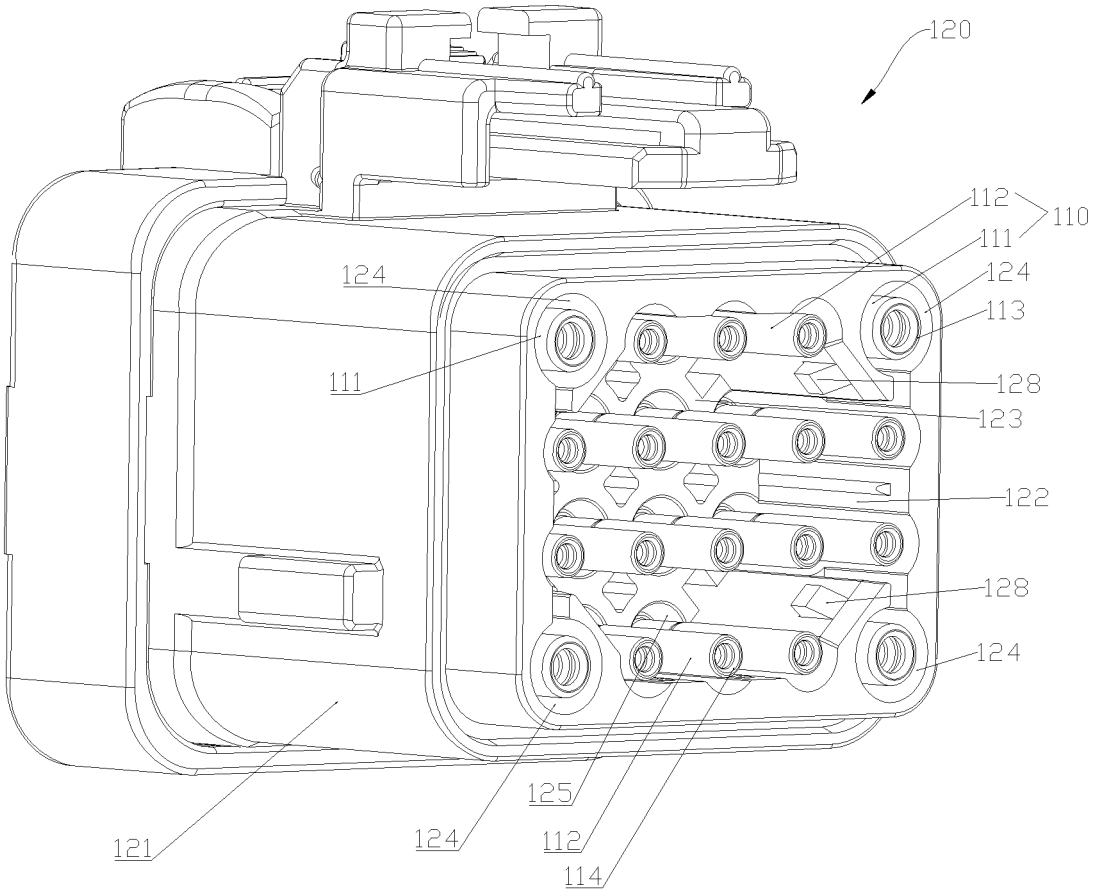
FIG. 7 is a structural schematic view of the connector assembly and a female terminal.
Figure 8:
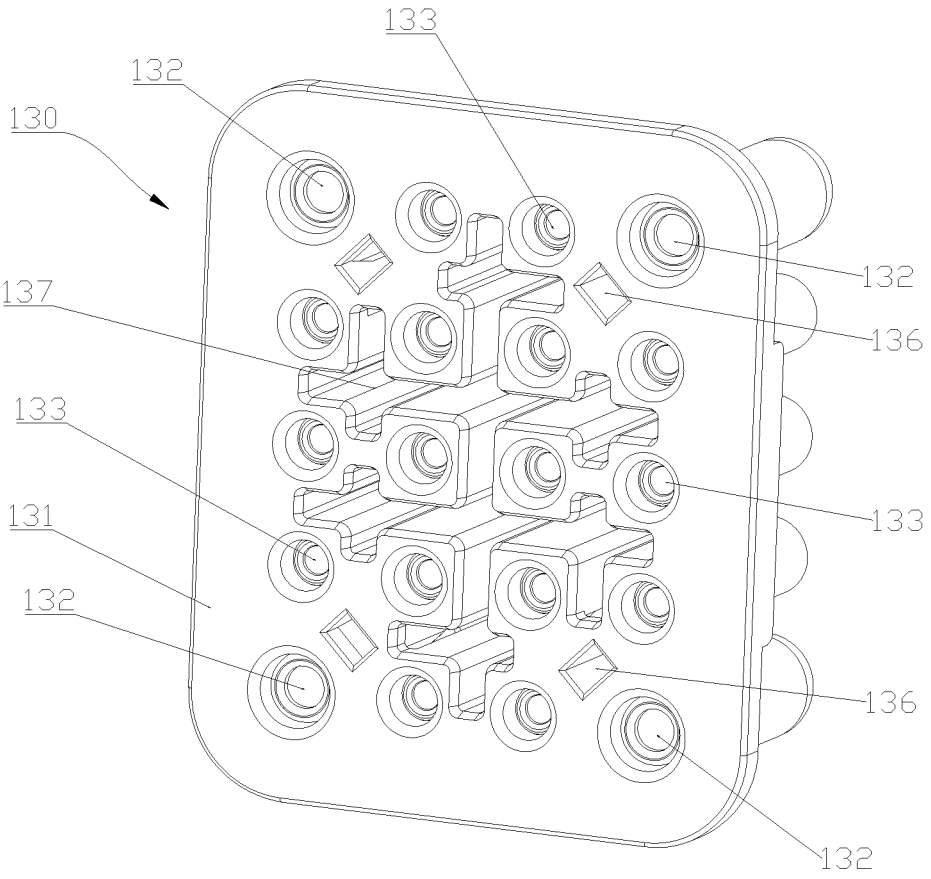
FIG. 8 is a structural schematic view of a first terminal retainer.
Figure 9:
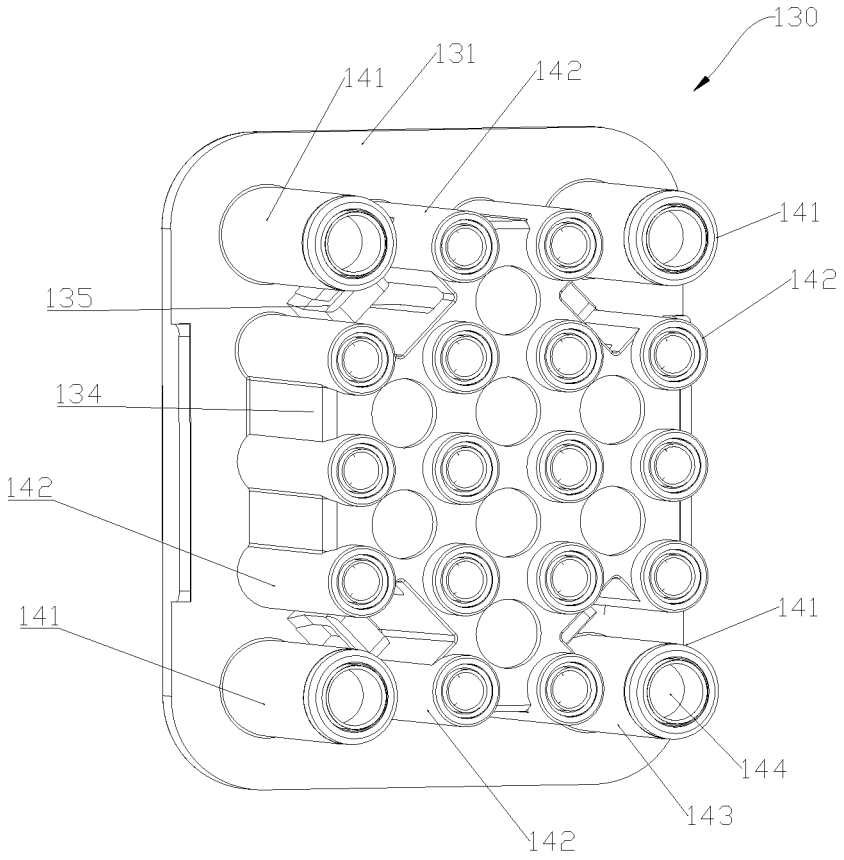
FIG. 9 is a structural schematic view of the first terminal retainer from another viewing angle.
Figure 10:
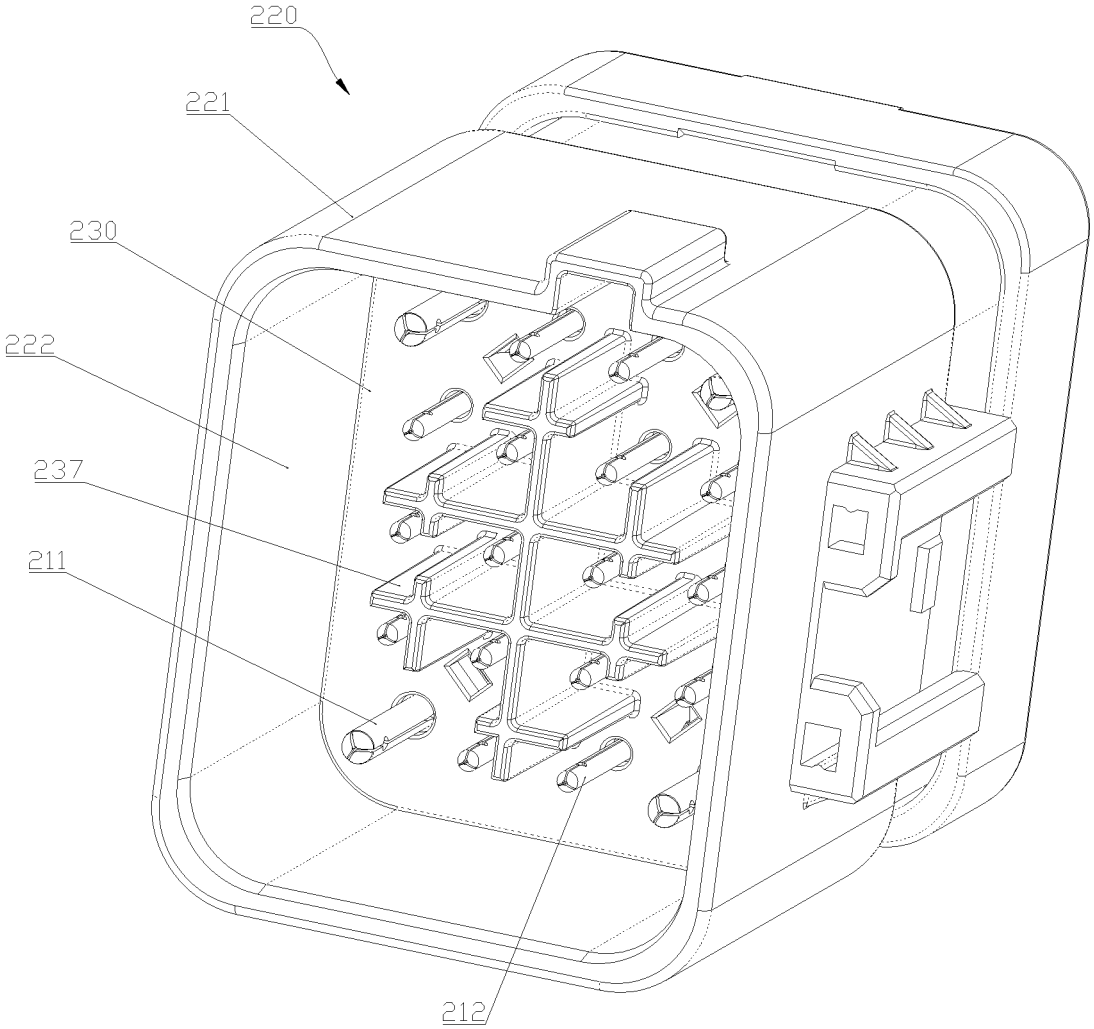
FIG. 10 is a structural schematic view of the mating connector assembly of the present application.
Figure 11:
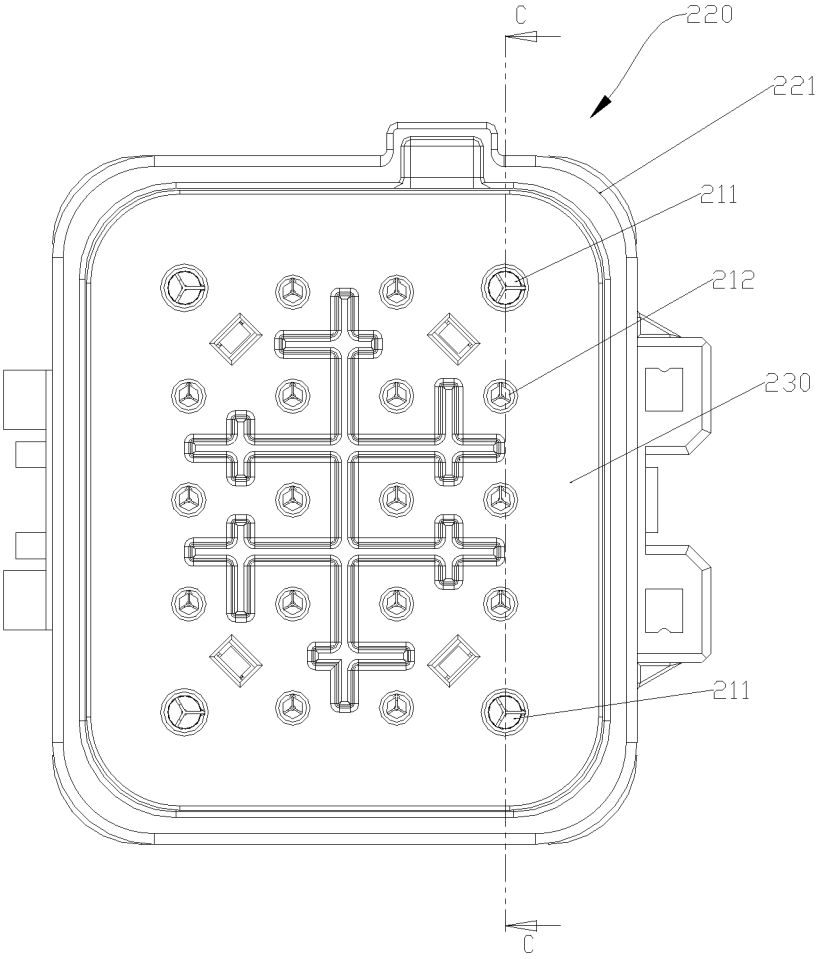
FIG. 11 is a front view of FIG. 10.
Figure 12:
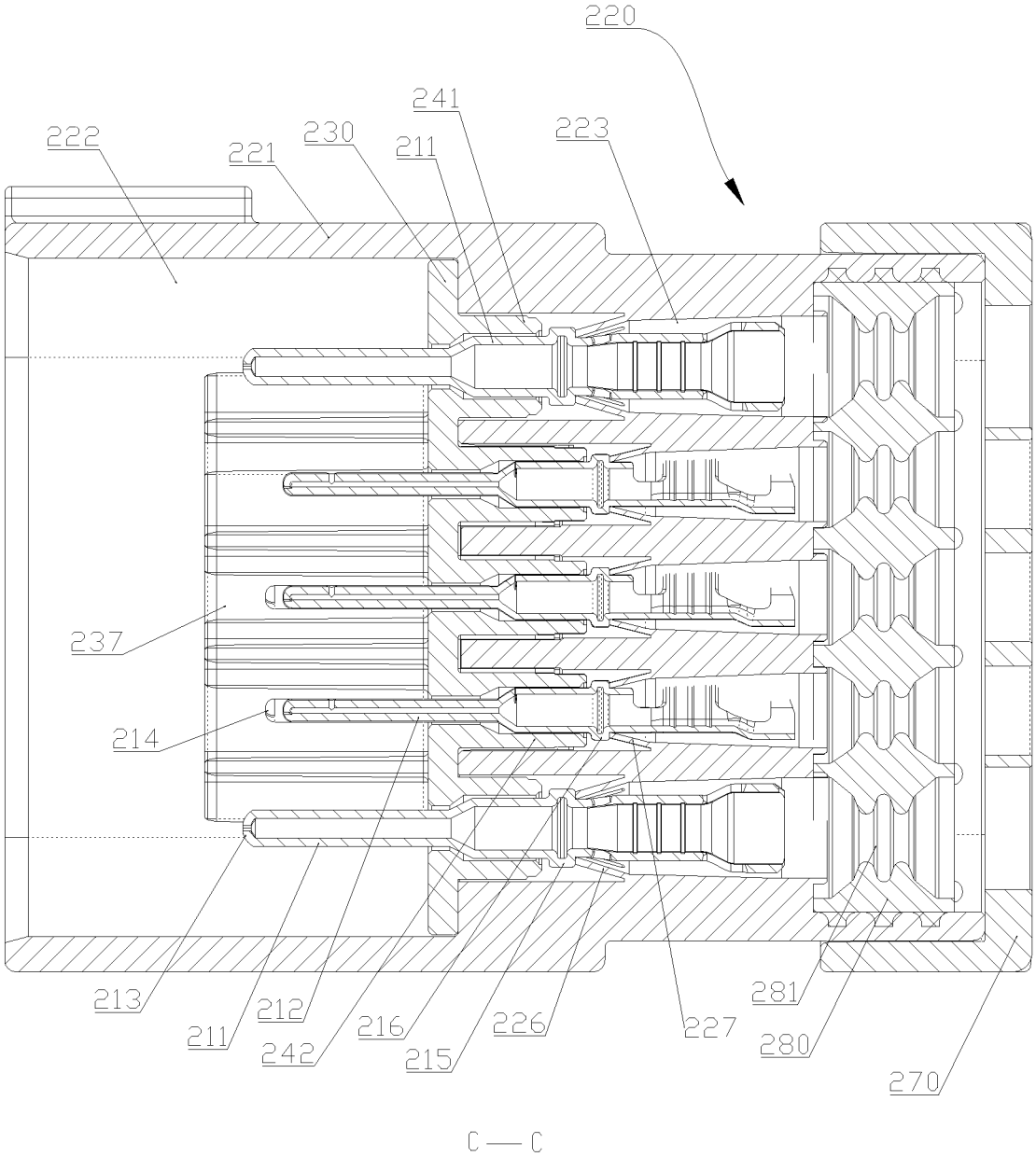
FIG. 12 is a C-C cross-sectional view of FIG. 11.
Figure 13:
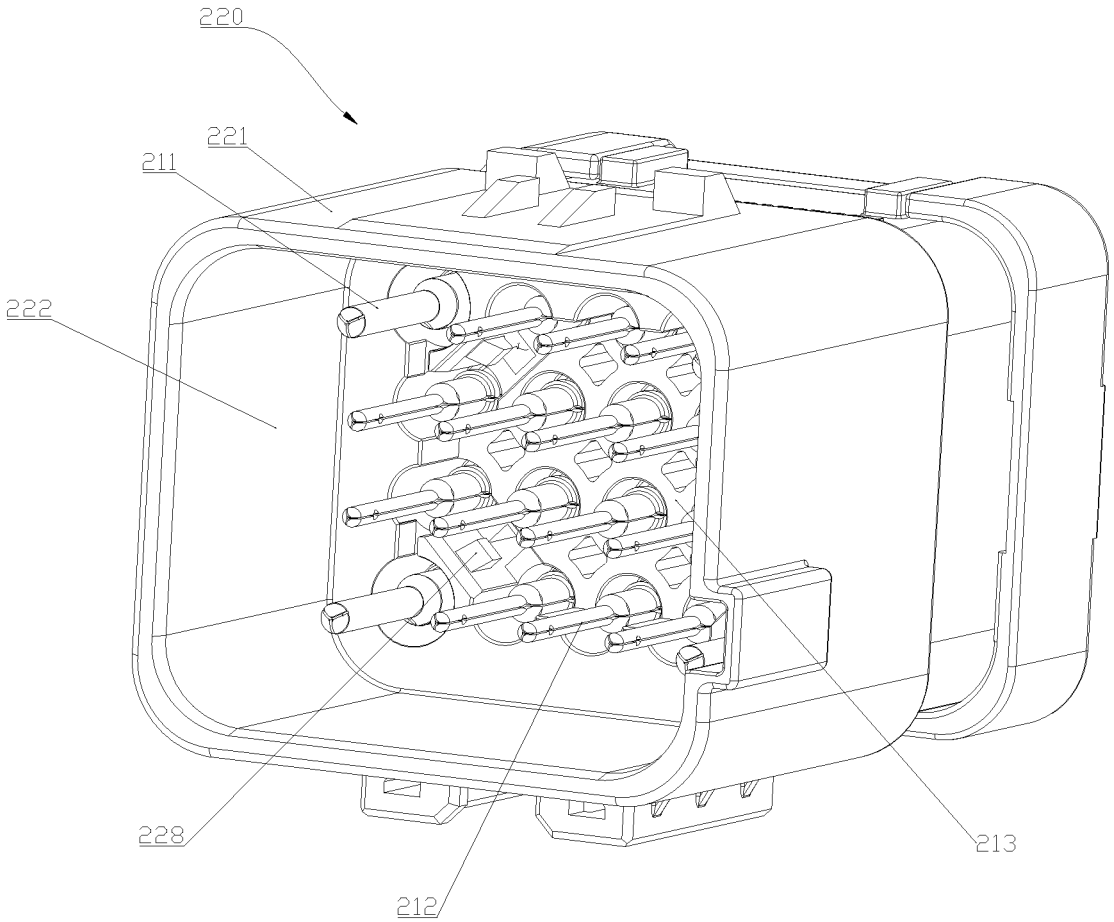
FIG. 13 is a structural schematic view of the mating connector and a male terminal.
Figure 14:
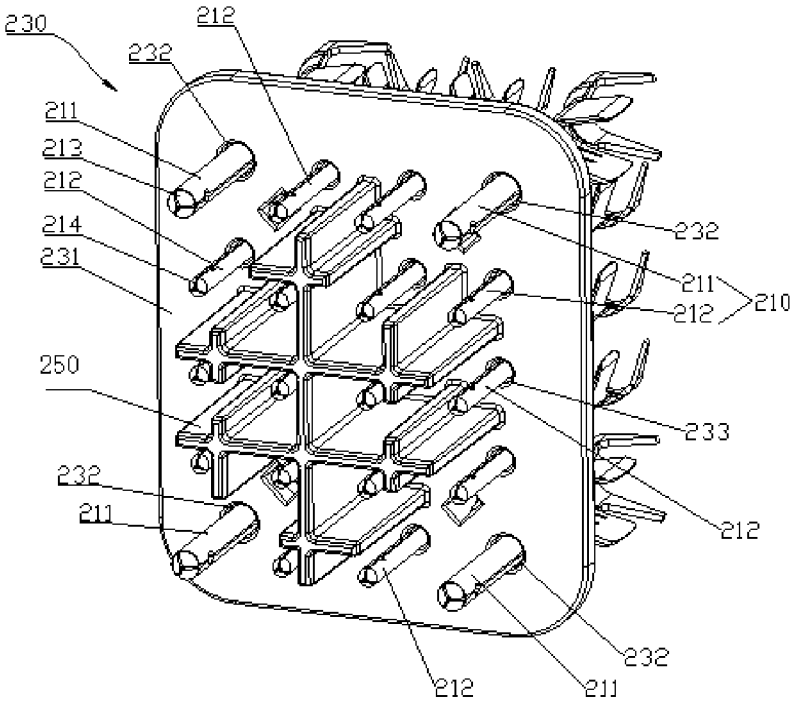
FIG. 14 is a structural schematic view of the terminal retainer and the male terminal.
Figure 15:
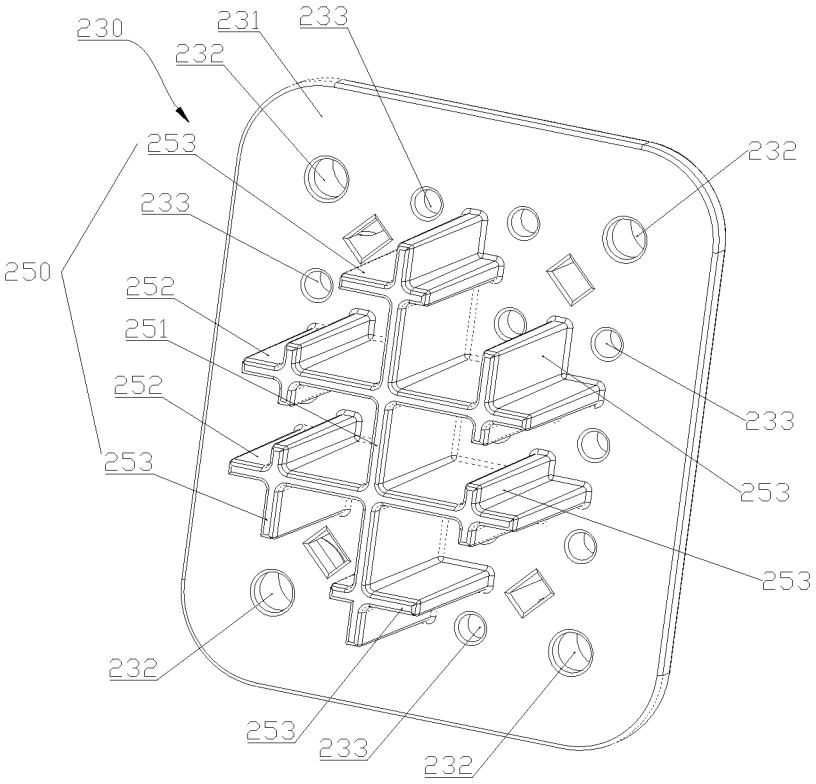
FIG. 15 is a structural schematic view of the terminal retainer.
Figure 16:
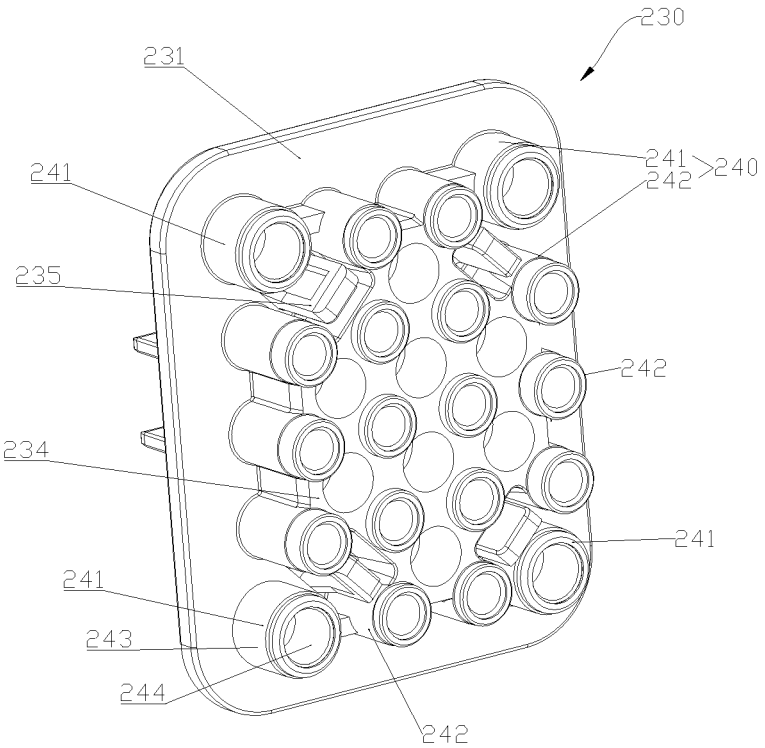
FIG. 16 is a structural schematic view of the second terminal retainer 2 from another viewing angle.

In the illustrated example, the female terminal 110 includes a first female terminal 111 and a second female terminal 112. The first female terminal 111 and the second female terminal 112 are both cylindrical. The first female terminal 111 has a cross-sectional dimension larger than that of the second female terminal 112; i.e., the first female terminal 111 has a diameter larger than that of the second female terminal 112. The first female terminal 111 has a first female terminal plug-in end 113, and is provided with a first female terminal flange 115. The second female terminal 112 has a second female terminal plug-in end 114, and is provided with a second female terminal flange 116. There are provided a plurality of the first female terminals 111 and the second female terminals 112. The size and number of the first female terminal 111 and the second female terminal 112 can be determined according to the actual circumstance of application. In the illustrated example, the number of the first female terminals 111 is four, and the four first female terminals 111 are identical. The number of the second female terminals 112 is sixteen, and the sixteen second female terminals 112 are identical. The four first female terminals 111 are arranged around the sixteen second female terminals 112. In the illustrated example, the four first female terminals 111 are arranged all around to define a rectangular shape, and the sixteen second female terminals 112 are disposed in the rectangular space defined by the four first female terminals 111. The first female terminal 111 is larger in size and configured for conducting a larger current, while the second female terminal 112 is smaller in size and configured for conducting less current. In the axial direction of the female terminal 110, the first female terminal plug-in end 113 is staggered with respect to the second female terminal plug-in end 114; that is, in the example shown in FIG. 6, the first female terminal plug-in end 113 is more leftward than the second female terminal plug-in end 114. As shown in FIG. 6, when the female terminal 110 is mounted, the first female terminal 111 is inserted into the first female terminal mounting hole 124 from right to left. The first female terminal flange 115 abuts against a plurality of the first female terminal clamping jaws 126 to prop them open. After the first female terminal flange 115 passes over the first female terminal clamping jaws 126, the first female terminal clamping jaws 126 contract and abut against the left end of the first female terminal flange 115 to prevent the first female terminal 111 from exiting the first female terminal mounting hole 124. The second female terminal 112 is inserted into the second female terminal mounting hole 125 from right to left. The second female terminal flange 116 abuts against a plurality of the second female terminal clamping jaws 127 to prop them open. After the second female terminal flange 116 passes over the second female terminal clamping jaws 127, the second female terminal clamping jaws 126 contract and abut against the left end of the second female terminal flange 116 to prevent the second female terminal 112 from exiting the second female terminal mounting hole 125.

The mating terminal retainer 130 has a structure including a mating plate body 131. The mating plate body 131 has a selected thickness. In the thickness direction, the mating plate body 131 is provided with a plurality of mating first through-holes 132 and a plurality of mating second through-holes 133 running through the mating plate body 131. The mating first through-hole 132 is configured for an end of the first female terminal 111 to be inserted in, and the mating first through-hole 132 is shaped and sized to adapt to the first female terminal 111. The mating second through-hole 133 is configured for an end of the second female terminal 112 to be inserted in, and the mating second through-hole 133 is shaped and sized to adapt to the second female terminal 112. The mating first through-hole 132 is larger in size than the mating second through-hole 133. The mating first through-hole 132 and the mating second through-hole 133 are positioned to correspond to the first female terminal 111 and the second female terminal 112, respectively. The number of the mating first through-holes 132 is four, and the number of the mating second through-holes 133 is sixteen. The four mating first through-holes 132 are disposed around the sixteen mating second through-holes 133. In the illustrated example, the four mating first through-holes 132 are arranged around to define a rectangular shape, and the sixteen mating second through-holes 133 are disposed in the rectangular space defined by the four mating first through-holes 132.

The mating plate body 131 is provided with a mating retaining block 134 which extends to a selected height from the mating plate body 131. To enhance the strength of the mating terminal retainer 130, the mating retaining block 134 has a specific height that can be determined according to practical requirements.

The mating terminal retainer 130 is further provided with a plurality of mating bushings 140 configured for protecting the female terminals 110 and isolating the female terminals 110 from each other. Therefore, according to the types of the female terminal 110, there are provided two types of the mating bushings 140, namely, a mating first bushing 141 and a mating second bushing 142. Each mating bushing 140 includes a mating tube wall 143 and a mating tube cavity 144. The mating tube wall 143 encloses the mating tube cavity 144. The mating first bushing 141 and the mating second bushing 142 are both connected to the mating plate body 131 at their ends. The mating tube cavity 144 of the mating first bushing 141 is aligned with the mating first through-hole 132 in position, and the end of the first female terminal 131 is inserted into the mating first through-hole 132 after the first female terminal 111 passes through the mating tube cavity 144 of the mating first bushing 141. The mating tube cavity 144 of the mating second bushing 142 is aligned with the mating second through-hole 133, and the end of the second female terminal 112 is inserted into the mating second through-hole 133 after the second female terminal 132 passes through the mating tube cavity 144 of the mating second bushing 142. The mating first bushing 141 and/or the mating second bushing 142 are/is connected to the mating retaining block 134. In the illustrated example, the mating second bushing 142 is connected to the mating retaining block 134, with a portion of the mating second bushing 142 passing through the mating retaining block 134. In the axial direction of the female terminal 110, the ends of the plurality of mating first bushings 141 and the ends of the plurality of mating second bushings 142 are arranged in a staggered manner so as to enable the plug-in ends of the plurality of female terminals 110 to be staggered. According to an embodiment of the present application, the plug-in ends of the first female terminal 111 and the second female terminal 112 may be staggered with respect to each other, or the plug-in ends of a plurality of the first female terminals 111 may be staggered with respect to each other, or the plug-in ends of a plurality of the second female terminals 112 may be staggered with respect to each other.

The mating terminal retainer 130 also includes a mating hook 135. The mating hook 135 is approximately a reverse U-shaped structure, which is connected with the mating plate body 131 and extends and protrudes from the mating plate body 131. The mating hook 135 is provided on the same side of the mating plate body 131 as the mating bushing 140 and the mating retaining block 134. The mating plate body 131 is further provided with a mating third through-hole 136 running through the plate body 131. The mating third through-hole 136 is provided at one side of the mating hook 135. The mating hook 135 is configured to be in hookup connection with the mating protrusion 128. From one side of the mating plate body 131, a force can be applied to the mating hook 135 through the mating third through-hole 136 using a tool to release the connection between the mating hook 135 and the mating protrusion 128. The mating terminal retainer 130 is further provided with an accommodating groove 137. The accommodating groove 137 extends from the mating plate body 131 to the mating retaining block 134 and is configured for accommodating a terminal isolation plate 237 described below.

The mating connector 120 in this embodiment also includes a sealing ring 150 and a first seal 160. The sealing ring 150 is disposed between the mating terminal retainer 130 and the housing 121 so that the two are sealed and connected. The first seal 160 is provided with a plurality of first perforations 161 and is configured for sealing a gap between the first female terminal 111 and/or the second female terminal 112 and the housing 121. The sealing ring 150 and the first seal 160 are positioned at the right and left ends of the mating connector 120, respectively, to seal both ends of the cavity 122. An end of the mating connector 120 is provided with a mating back cover 170 that confines the first seal 160 within the mating cavity 122.

The mating terminal retainer 130 is partially inserted into the mating cavity 122 of the mating housing 121. The mating bushing 140 is disposed inward, and the mating plate body 131 is disposed outward. The mating hook 135 hooks onto the mating protrusion 128. The mating hook 135 is mutually mated with the mating protrusion 128 to secure the mating terminal retainer 130 within the mating cavity 122. The first sealing ring 150 is fitted over the mating terminal retainer 130. The first female terminal 111 is inserted into the mating cavity 122 of the mating connector 120 through the mating first through-hole 161 and the mating first bushing 141 so that the end of the first female terminal 111 is located in the mating first through-hole 132. The second female terminal 112 is inserted into the mating cavity 122 of the mating connector 120 through the mating first through-hole 161 and the mating second bushing 142 so that the end of the second female terminal 112 is located in the mating second through-hole 133.

As shown in FIGS. 10 to 16, a connector assembly 200, for mating with connector assembly 110, includes a connector 220, a male terminal 210, and a retainer 230.

The connector 220 has a housing 221 and a cavity 222. The housing 221 extends lengthwise for a selected length, and a desirable length and outer shape can be determined according to a circumstance of application. The housing 221 encloses the cavity 222. The connector 220 is configured for mounting a connection terminal, and in this embodiment, the connection terminal are illustrated as the male terminal 210. The male terminal 210 includes a first male terminal 211 and a second male terminal 212. A structure for mounting the male terminal 210 is provided in the cavity 222. The structure may be a solid structure or another usable structure as long as it can fixedly mount the male terminal 210 in the housing 221. In the illustrated example, within the cavity 222 is provided a male terminal retaining portion 223 configured for fixing the male terminal 210. The male terminal retaining portion 223 is provided with a plurality of first male terminal mounting holes 224 configured for receiving the first male terminal 211 and a plurality of second male terminal mounting holes 225 configured for receiving the second male terminal 212. The first male terminal mounting hole 224 has a cross-sectional dimension larger than that of the second male terminal mounting hole 225. In the illustrated example, the first male terminal mounting hole 224 and the second male terminal mounting hole 225 are both round holes, and the first male terminal mounting hole 224 has a diameter larger than that of the second male terminal mounting hole 225. In this embodiment, the number of the first male terminal mounting holes 224 is four. The number of the second male terminal mounting holes 225 is sixteen. The four first male terminal mounting holes 224 are disposed around all of the sixteen second male terminal mounting holes 225. The four first male terminal mounting holes 224 are provided at four corners, and the sixteen second male terminal mounting holes 225 are provided within a rectangular shape defined by the four first male terminal mounting holes 224.

Within the first male terminal mounting hole 224 is provided a first stopper configured for preventing the first male terminal 211 from exiting. In the illustrated example, the first stopper includes a plurality of first male terminal clamping jaws 226 spaced circumferentially along the first male terminal mounting hole 224; each of the first male terminal clamping jaws 226 is disposed to be elastic. In an insertion direction of the first male terminal 211, a plurality of the first male terminal clamping jaws 226 are provided to form a tapered tube shape; that is, in the example shown, the first male terminal clamping jaws 226 reduce gradually in size from right to left.

Within the second male terminal mounting hole 225 is provided a second stopper configured for preventing the second male terminal 212 from exiting. The second stopper includes a plurality of second male terminal clamping jaws 227 spaced circumferentially along the second male terminal mounting hole 225; each of the second male terminal clamping jaws 227 is disposed to be elastic; in an insertion direction of the second male terminal 212, a plurality of the second male terminal clamping jaws 227 are arranged to form a tapered tube shape; that is, in the example shown, the second male terminal clamping jaws 227 reduce gradually in size from right to left.

In a length direction of the housing 221, the plurality of the first male terminal clamping jaws 226 in the first male terminal mounting hole 224 are arranged in a staggered manner; the plurality of the second male terminal clamping jaws 227 in the second male terminal mounting hole 225 are arranged in a staggered manner; and/or the first male terminal clamping jaws 226 in the first male terminal mounting hole 224 and the second male terminal clamping jaws 227 in the second male terminal mounting hole 225 are arranged in a staggered manner with respect to each other. In the example shown in FIG. 12, in an axial direction of the male terminal 210, the first male terminal clamping jaws 226 are more leftward than the second male terminal clamping jaws 227.

A protrusion 228 is provided in the cavity 222 of the housing 221. The protrusion 228 is configured to hook a hook 235 described below as a mating structure to the hook 235.

In the example shown, the male terminal 210 includes a first male terminal 211 and a second male terminal 212. The first male terminal 211 and the second male terminal 212 are both cylindrical. The first male terminal 211 has a cross-sectional dimension larger than that of the second male terminal 212; i.e., the first male terminal 211 has a diameter larger than that of the second male terminal 212. The first male terminal 211 has a first male terminal plug-in end 213, and is provided with a first male terminal flange 215. The second male terminal 212 has a second male terminal plug-in end 214, and is provided with a second male terminal flange 216. There are provided a plurality of the first male terminals 211 and the second male terminals 212. The size and number of the first male terminal 211 and the second male terminal 212 can be determined according to the actual circumstance of application. In the example shown, the number of the first male terminals 211 is four, and the four first male terminals 211 are identical. The number of the second male terminals 212 is sixteen, and the sixteen second male terminals 212 are identical. The four first male terminals 211 are arranged around the sixteen second male terminals 212. In the illustrated example, the four first male terminals 211 are arranged all around to define a rectangular shape, and the sixteen second male terminals 212 are disposed in the rectangular space defined by the four first male terminals 211. The first male terminal 211 is larger in size and configured for conducting a larger current, while the second male terminal 212 is smaller in size and configured for conducting less current. In the axial direction of the male terminal 210, the first male terminal plug-in end 213 is staggered with respect to the second male terminal plug-in end 214; that is, in the example shown in FIG. 12, the first male terminal plug-in end 213 is more leftward than the second male terminal plug-in end 214. When the male terminal 210 is mounted, the first male terminal 211 is inserted into the first male terminal mounting hole 224 from right to left. The first male terminal flange 215 abuts against a plurality of the first male terminal clamping jaws 226 to prop them open. After the first male terminal flange 215 passes over the first male terminal clamping jaws 226, the first male terminal clamping jaws 226 contract and abut against the right end of the first male terminal flange 215 to prevent the first male terminal 211 from exiting the first male terminal mounting hole 224. The second male terminal 212 is inserted into the second male terminal mounting hole 225 from right to left. The second male terminal flange 216 abuts against a plurality of the second male terminal clamping jaws 227 to prop them open. After the second male terminal flange 216 passes over the second male terminal clamping jaws 227, the second male terminal clamping jaws 226 contract and abut against the right end of the second male terminal flange 216 to prevent the second male terminal 212 from exiting the second male terminal mounting hole 225.

The terminal retainer 230 has a structure including a plate body 231. The plate body 231 has a selected thickness. In the thickness direction, the plate body 231 is provided with a plurality of first through-holes 232 and a plurality of second through-holes 233 running through the plate body 231. The first through-hole 232 is configured for an end of the first male terminal 211 to be inserted in, and the first through-hole 232 is shaped and sized to adapt to the first male terminal 211. The second through-hole 233 is configured for an end of the second male terminal 212 to be inserted in, and the second through-hole 233 is shaped and sized to adapt to the second male terminal 212. The first through-hole 232 is larger in size than the second through-hole 233. The first through-hole 232 and the second through-hole 233 are positioned to correspond to the first male terminal 211 and the second male terminal 212, respectively. The number of the first through-holes 232 is four, and the number of the second through-holes 233 is sixteen. The four first through-holes 232 are disposed around the sixteen second through-holes 233. In the example shown, the four first through-holes 232 are arranged all around to define a rectangular shape, and the sixteen second through-holes 233 are disposed in the rectangular space defined by the four first through-holes 132.

The plate body 231 is provided with a retaining block 234 which extends to a selected height from the plate body 231. The retaining block 234 is configured to enhance the strength of the terminal retainer 230 and a specific height thereof can be determined according to practical requirements.

The second terminal retainer 230 is further provided with a bushing 240 configured for protecting the male terminals 210 and isolating the male terminals 210 from each other. Therefore, according to the types of the male terminal 210, there are provided two types of the bushing 240, namely, a first bushing 241 and a second bushing 242. Each bushing 240 includes a tube wall 243 and a tube cavity 244. The tube wall 243 encloses the tube cavity 244. The first bushing 241 and the second bushing 242 are both connected to the plate body 231 at their ends. The tube cavity 244 of the first bushing 241 is aligned with the first through-hole 232 in position, and the end of the first male terminal 211 protrudes from the plate body 231 after the first male terminal 211 passes through the tube cavity 244 of the first bushing 241 and the first through-hole 232. The tube cavity 244 of the second bushing 242 is aligned with the second through-hole 233, and the end of the second male terminal 212 protrudes from the plate body 231 after the second male terminal 212 passes through the tube cavity 244 of the second bushing 242 and the second through-hole 233. The first bushing 241 and/or the second bushing 242 are/is connected to the retaining block 234. In the example shown, the second bushing 242 is connected to the retaining block 234, with a portion of the second bushing 242 passing through the retaining block 234.

The second terminal retainer 230 also includes a hook 235. The hook 235 is a reverse U-shaped structure, which is connected with the plate body 231 and extends and protrudes from the plate body 231. The hook 235 is provided on the same side of the plate body 231 as the bushing 240 and the retaining block 234. The plate body 231 is further provided with a third through-hole 236 running through the plate body 231. The third through-hole 236 is provided at one side of the hook 235. The hook 235 is configured to be in hookup connection with the protrusion 228. From one side of the plate body 231, a force can be applied to the hook 235 through the third through-hole 236 using a tool to release the connection between the hook 235 and the protrusion 228.

The terminal retainer 230 further includes a terminal isolation plate 250. An end of the terminal isolation plate 250 is disposed on the plate body 231 and extends to a selected height from the plate body 231. The terminal isolation plate 250 is disposed between a plurality of the first through-holes 232, between a plurality of the second through-holes 233, and/or between the first through-hole 232 and the second through-hole 233. In the example shown, the terminal isolation plate 250 is positioned between a plurality of the second through-holes 233 to isolate the plurality of second through-holes 233. The terminal isolation plate 250 may either form a closed tube cavity surrounding the second through-hole 233, or form a semi-open space only partially surrounding the second through-hole 233.

In the example shown, the terminal isolation plate 250 includes a plurality of vertical plates 251 and a plurality of transverse plates 252, the plurality of vertical plates 251 being disposed to intersect the plurality of transverse plates 252. As shown, there are provided one vertical plate 251 and two transverse plates 252 in total. The vertical plate 251 extends from an upper portion to a lower portion of the plate body 231 to isolate two adjacent rows of the second through-holes 233. The two transverse plates 252 extend from a left portion to a right portion of the plate body 231 to isolate two adjacent upper and lower rows of the second through-holes 233.

The terminal isolation plate 250 further includes a short baffle 253 which is provided on the vertical plate 251 and/or the transverse plate 252 and protrudes from the vertical plate 251 or the transverse plate 252 toward one side or both sides. The short baffle 253 protrudes from both sides of the transverse plate 252 to an identical or different length; the short baffle 253 protrudes from both sides of the vertical plate 251 to an identical or different length. In the example shown, at either end of the vertical plate 251 is provided a short baffle 253 that extends toward either side of the vertical plate 251 and protrudes from the vertical plate 251 to a different length. At either end of each transverse plate 252 is provided a short baffle 253 which extends up and down the transverse plate 252 and protrudes from the transverse plate 252 to a different length. Each of the short baffles 253 is positioned between two adjacent second through-holes 233 to isolate the two adjacent second through-holes 233. The vertical plate 251, the transverse plate 252 and the short baffle 253 surround the second through-hole 233 in a semi-closed manner. In the illustrated example, the terminal isolation plate 250 is a centrosymmetric structure, i.e., its structure being the same before and after a rotation of 180 degrees.

The connector 220 in this embodiment also includes a second seal 280. The second seal 280 is provided with a plurality of perforations 281 and is configured for sealing the gap between the first male terminal 211 and/or the second male terminal 212 and the housing 221. The second seal 280 is positioned at the right end of the housing 221. At the right end of the connector 220 is provided a back cover 270 which confines the second seal 280 within the cavity 222.

The second terminal retainer 230 is disposed within the cavity 222 of the housing 221. The bushing 240 is disposed inward and the plate body 231 is disposed outward. The hook 235 hooks onto the protrusion 228. The hook 235 is mutually mated with the protrusion 228 to secure the second terminal retainer 230 within the cavity 222. The first male terminal 211 is inserted into the cavity 222 of the connector 220, and the second male terminal 212 passes through the second perforation 281, the first bushing 241 and the plate body 231 to protrude from the plate body 231. The second male terminal 212 is inserted into the cavity 222 of the connector 220, and the second male terminal 212 passes through the second perforation 281, the second bushing 242, and the plate body 231, with the end thereof protruding from the plate body 231. The terminal isolation plate 237 isolates a plurality of the second male terminals 212.

Figure 17:
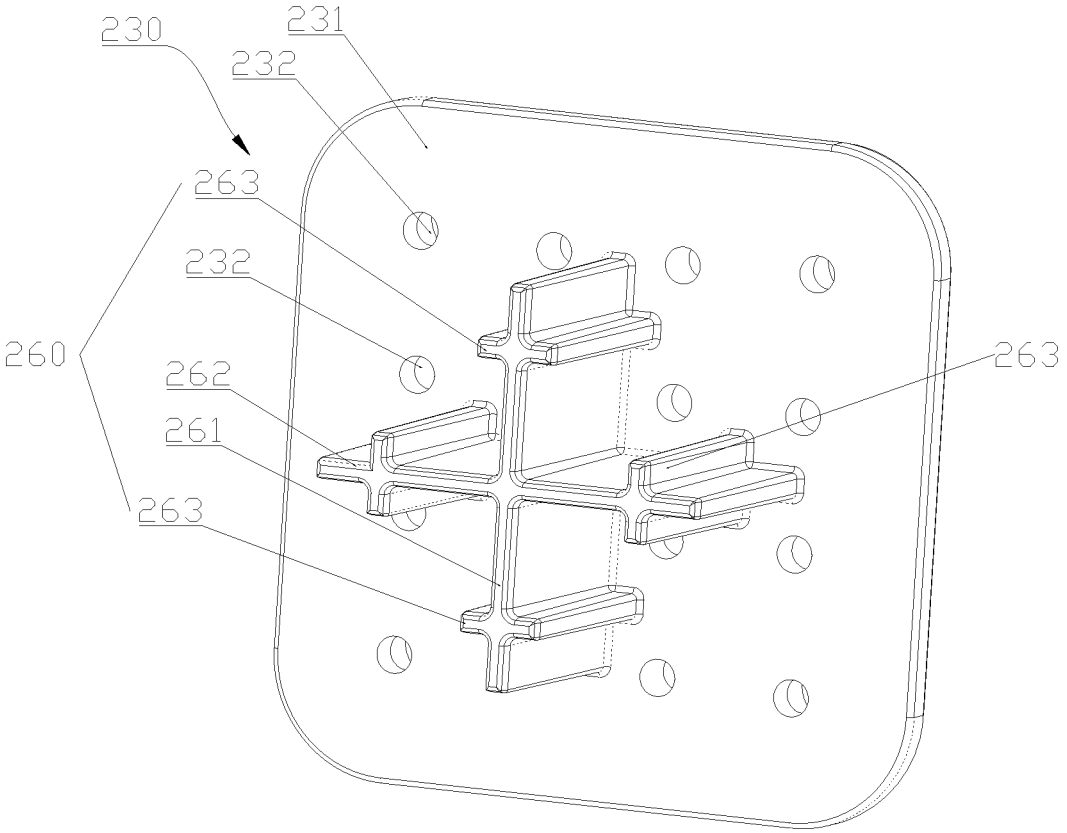
FIG. 17 is a structural schematic view of the terminal retainer in an alternate embodiment.

FIG. 17 is a structural schematic view of another embodiment of the terminal retainer. In the example shown in FIG. 17, the terminal isolation plate 280 is structurally different from the terminal isolation plate 250, and the plate body 231 is provided with only the first through-holes 232 which are all the same in size. In this embodiment, the terminal isolation plate 280 includes one vertical plate 261 and one transverse plate 262 which are disposed to intersect. The vertical plate 261 extends from an upper portion to a lower portion of the plate body 231 to isolate two adjacent rows of the second through-holes 233. The transverse plate 262 extends from a left portion to a right portion of the plate body 231 to isolate two adjacent upper and lower rows of the first through-holes 232.

The terminal isolation plate 280 further includes a short baffle 263 which is provided on both the vertical plate 261 and the transverse plate 262 and protrudes from the vertical plate 261 or the transverse plate 262 toward either side. The short baffle 263 protrudes from either side of the transverse plate 262 to an identical length; the short baffle 263 protrudes from either side of the vertical plate 261 to an identical length. In the example shown, at either end of the vertical plate 261 is provided one short baffle 263 that extends toward either side of the vertical plate 261 and protrudes from the vertical plate 261 to an identical length. At either end of the transverse plate 262 is provided one short baffle 263 which extends up and down the transverse plate 262 and protrudes from the transverse plate 262 to an identical length. Each of the short baffles 263 is positioned between two adjacent first through-holes 232 to isolate the two adjacent first through-holes 232. The vertical plate 261, the transverse plate 262 and the short baffle 263 surround the first through-hole 232 in a semi-closed manner. In the illustrated example, the terminal isolation plate 280 is a centrosymmetric structure, i.e., its structure being the same before and after a rotation of 180 degrees.

In use, the mating connector assembly 100 is mated and connected with the connector assembly 200 of Embodiment 2. The mating connector 120 is in plug-in connection with the connector 220, and the male terminal 210 is in plug-in connection with the female terminal 110. The terminal isolation plate 250 or the terminal isolation plate 280 is inserted into the accommodating groove 137. During plugging in, the first female terminal 111 firstly contacts the first male terminal 211, and the second female terminal 112 contacts the second male terminal 212 after plugging in by a length.

Both the mating connector assembly 100 and the connector assembly 200 are embodiments of the connector assembly in the present application. Both the mating connector 120 and the connector 220 are embodiments of the connector in the present application. Both the first female terminal 111 and the second female terminal 112 are embodiments of the female terminal in the present application. Both the first male terminal 211 and the second male terminal 212 are embodiments of the male terminal in the present application. Both the first female terminal mounting hole 124 and the first male terminal mounting hole 224 are embodiments of the first mounting hole in the present application. Both the second female terminal mounting hole 125 and the second male terminal mounting hole 225 are embodiments of the second mounting hole in the present application.

Either of the mating terminal retainer 130 and the terminal retainer 230 is one of the embodiments of the terminal retainer described in the present application.

Compared with prior art, the terminal retainer provided by the application can help the connection terminal to be stable and firm. During plugging in, the terminal retainer can prevent the connection terminal from being bent or broken under stress, so that it is safe and convenient to use. The terminal retainer is provided with a bushing, so that the connection terminals can be isolated from each other to avoid mutual interference. The arrangement of the retaining block may enhance the firmness of the terminal retainer, and enable the connection terminal to be more stable and safer to use. The arrangement of the terminal isolation plate enables the terminal retainer to be more suitable for mounting the male terminal; the bushing and the isolation plate are separately provided on two surfaces of the plate body, and therefore the male terminals on either side of the plate body can be isolated or protected. Different heights of the bushings may enable the ends of the connection terminals to be axially staggered, so that during plugging in some of the male terminals firstly contact some of the female terminals, which requires a small force to plug in. The terminal retainer is provided with a hook, so that the terminal retainer can be conveniently hooked up and connected with the mating structure in the connector cavity. The plate body is provided with a third through-hole disposed on one side of the hook, so that the hook can be disconnected from the mating structure through the third through-hole, and the terminal retainer can be conveniently disassembled.

The invention claimed is:

1. A terminal retainer configured to be mounted into a connector housing formed with mating cavities for retaining connection terminals in the mating cavities, the terminal retainer comprising a plate body, a terminal isolation plate and a plurality of bushings; wherein the plate body is provided with at least one of a plurality of first through-holes and a plurality of second through-holes; and wherein the terminal isolation plate has one end disposed on the plate body and extends to a selected height from the plate body, the bushings are arranged to be aligned with the at least one of the plurality of first through-holes and the plurality of second through-holes in position so that the connection terminals can be inserted into the at least one of the plurality of first through-holes and the plurality of second through-holes from the bushings.

2. The terminal retainer according to claim 1, wherein the terminal isolation plate is provided between the at least one of the plurality of first through-holes and the plurality of second through-holes.

3. The terminal retainer according to claim 1, wherein the terminal isolation plate comprises a plurality of vertical plates and a plurality of transverse plates, the plurality of vertical plates being disposed to intersect the plurality of transverse plates; and at least some of the vertical plates extend from an upper portion to a lower portion of the plate body.

4. The terminal retainer according to claim 3, wherein at least some of the transverse plates extend from a left portion to a right portion of the plate body.

5. The terminal retainer according to claim 3, wherein the terminal isolation plate further comprises a short baffle which is disposed on at least one vertical plate and at least one transverse plate and protrudes from the at least one vertical plate and the at least one transverse plate towards one side or both sides.

6. The terminal retainer according to claim 5, wherein the short baffle protrudes from both sides of the at least one transverse plate to an identical or different length; and the short baffle protrudes from both sides of the at least one vertical plate to an identical or different length.

7. The terminal retainer according to claim 1, wherein the terminal isolation plate surrounds the at least one of the plurality of first through-holes and the plurality of second through-holes in a closed or semi-closed manner.

8. The terminal retainer according to claim 1, wherein the terminal isolation plate is a rotationally symmetric structure.

9. The terminal retainer according to claim 8, wherein the terminal isolation plate is a centrosymmetric structure or has a rotation angle of 90 degrees.

10. The terminal retainer according to claim 1, wherein the terminal retainer is a centrosymmetric structure.

11. The terminal retainer according to claim 1, wherein a plurality of first through-holes of the plate body are arranged around a plurality of second through-holes of the plate body; each of the plurality of first through-holes is axially aligned with one of first mounting holes; and each of the plurality of second through-holes is axially aligned with one of second mounting holes.

12. The terminal retainer of claim 1, wherein the bushings have tube walls and tube cavities; one end of each of the bushings is disposed on the plate body, and the other end of each of the bushings protrudes from the plate body; and the tube cavities are arranged to be aligned with the at least one of the plurality of first through-holes and the plurality of second through-holes in position so that the connection terminals can be inserted into the at least one of the plurality of first through-holes and the plurality of second through-holes from the tube cavities.

13. The terminal retainer of claim 12, wherein the bushings comprise a first bushing and a second bushing; the first bushing is provided with a first tube wall and a first tube cavity; each of the first tube cavities is disposed in position to be aligned with a plurality of first through-holes; the second bushing is provided with a second tube wall and a second tube cavity; and each of the second tube cavities is disposed in position to be aligned with a plurality of second through-holes.

14. The terminal retainer according to claim 12, wherein the plate body is provided with a retaining block which extends to a selected height from the plate body; and at least some of the bushings are inserted into the retaining block.

15. The terminal retainer of claim 1, wherein the terminal retainer further comprises a hook; and the hook has one end disposed on the plate body and extends to a selected height from the plate body.

16. The terminal retainer according to claim 15, wherein the plate body is provided with a third through-hole which runs through the plate body and is disposed on one side of the hook.

17. The terminal retainer of claim 1, combined with a mating terminal retainer, the mating terminal retainer comprising a retainer plate body, wherein the retainer plate body is provided with an accommodating groove for accommodating the terminal isolation plate.

18. The terminal retainer of claim 1, wherein the terminal isolation plate has at least one vertical plate and at least one transverse plate, the at least one vertical plate being disposed to intersect the at least one transverse plate, the at least one transverse plate extending to isolate two adjacent rows of a plurality of first through-holes, the at least one vertical plate extending to isolate two upper and lower rows of a plurality of second through-holes.

19. The terminal retainer of claim 18, wherein the terminal isolation plate has at least one short baffle which is disposed on the at least one vertical plate or the at least one transverse plate and protrudes from the at least one vertical plate or the at least one transverse plate, the at least one short baffle is spaced from the at least one transverse plate or the at least one vertical plate and extends parallel to the at least one transverse plate or the at least one vertical plate, the at least one short baffle has a length which is less than a length of the at least one transverse plate or the at least one vertical plate.

* * * * *